US008734093B2

(12) United States Patent
Yen et al.

(10) Patent No.: US 8,734,093 B2
(45) Date of Patent: May 27, 2014

(54) MECHANISM FOR MODULATING DIFFUSER VANE OF DIFFUSER

(75) Inventors: Cheng-Chung Yen, Hsinchu (TW); Chung-Ping Chiang, Hsinchu (TW); Ching-Fu Chen, Hsinchu (TW); Yung-Lo Chow, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 743 days.

(21) Appl. No.: 12/978,726

(22) Filed: Dec. 27, 2010

(65) Prior Publication Data

US 2012/0134784 A1 May 31, 2012

(30) Foreign Application Priority Data

Nov. 25, 2010 (TW) ..... 99140713 A

(51) Int. Cl.
*F04D 29/46* (2006.01)
*F01D 17/16* (2006.01)

(52) U.S. Cl.
CPC ..... *F04D 29/462* (2013.01); *F01D 17/165* (2013.01)
USPC ..... 415/164; 415/166

(58) Field of Classification Search
USPC ..... 415/151, 152.2, 159, 162, 164, 165, 415/166
See application file for complete search history.

(56) References Cited

U.S. PATENT DOCUMENTS 2,300,766 A * 11/1942 Baumann ..... 415/149.1
3,243,159 A 3/1966 Hefler et al.
3,704,540 A * 12/1972 Montagu ..... 446/40
4,498,647 A * 2/1985 Boehringer et al. ..... 244/99.3
4,657,476 A * 4/1987 Berg ..... 415/48
4,741,666 A * 5/1988 Shimizu et al. ..... 415/158
4,770,605 A * 9/1988 Nakatomi ..... 415/148
5,116,197 A 5/1992 Snell
6,547,520 B2 * 4/2003 Zinsmeyer et al. ..... 415/150

(Continued)

FOREIGN PATENT DOCUMENTS

CN 1132828 A 10/1996
CN 1526051 A 9/2004
CN 1560479 A 1/2005
JP H11117898 A 4/1999

OTHER PUBLICATIONS

Chinese Patent Office, Office Action, Patent Application Serial No. CN201010589114.6, Nov. 28, 2013, China.

*Primary Examiner* — Edward Look
*Assistant Examiner* — Jason Davis
(74) *Attorney, Agent, or Firm* — Rabin & Berdo, P.C.

(57) ABSTRACT

A mechanism modulates a fluid flow in a diffuser flow path of a compressor diffuser, including: a shroud disposed on the diffuser flow path and having a cam and a driving wheel fixed base; a diffuser vane having a diffuser guide vane disposed in the diffuser flow path and a diffuser vane shaft fixedly disposed on the diffuser vane that penetrates from the diffuser flow path through the shroud; a driving ring sleeved on the cam and having a moving bar; a sliding block having one end connected with one end the diffuser vane shaft that penetrates through the shroud, and the other end sleeved on a sliding groove formed on the moving bar; a driving wheel disposed in the driving wheel fixed base and having a driving shaft connected to an actuator outside of the compressor; and a driving cable connected to the driving wheel and the driving ring.

13 Claims, 5 Drawing Sheets

(56) References Cited

U.S. PATENT DOCUMENTS

| | | | | |
|---|---|---|---|---|
| 6,575,270 | B2 * | 6/2003 | Farenden | 188/2 D |
| 6,763,587 | B2 * | 7/2004 | Jinnai et al. | 29/889.2 |
| 2002/0176774 | A1 * | 11/2002 | Zinsmeyer et al. | 415/150 |
| 2003/0026694 | A1 * | 2/2003 | Groskreutz et al. | 415/164 |
| 2004/0004330 | A1 * | 1/2004 | Smyler | 280/11.212 |
| 2004/0213665 | A1 * | 10/2004 | Ohishi et al. | 415/151 |
| 2008/0287862 | A1 * | 11/2008 | Weitzner et al. | 604/28 |

* cited by examiner

MECHANISM FOR MODULATING DIFFUSER VANE OF DIFFUSER

BACKGROUND

1. Field of the Invention

The present invention relates to a mechanism for modulating the diffuser vane of a compressor diffuser, and, more particularly, to a mechanism that modulates the disposition of diffuser vanes in a compressor diffuser by means of radial power transmission.

2. Description of Related Art

In order to suppress a compressor surge and to expand operating ranges of low negative loads, diffuser vanes have been brought into the design mainstream to dynamically alter the flow direction of the flow path in a compressor diffuser. For instance, U.S. Pat. No. 5,116,197 disclosed a technique of disposing diffuser vanes in a compressor, in which the actuator transmits the power through a plurality of connectors, including rolling balls, connecting poles, cams and driving rings, to diffuser vanes, in order to modulate disposal angles thereof in the flow path of the compressor diffuser, which in turn dynamically changes the direction of flowing liquids in the flow path of the compressor. U.S. Pat. No. 3,243,159 disclosed a technique of transmitting power of the actuator by using gears of sliding blocks to change the flow direction in the flow path of a compressor. However, there still exist several disadvantages in the foregoing approaches including space-consuming, complex assembly and burdensome maintenance. Besides the drawbacks of having complex structures, both the foregoing applications adopt transmitting power of the actuator along the compressor axle, which requires actuators to be disposed in the compressor. In so doing, not only it requires the design and reservation of a relatively larger space for accommodating the actuator in the compressor, but also a string of steps would be necessary for assembling the compressor and connecting the actuator to diffuser vanes, which then again ensue complicated manual works for the dysfunctional or damaged actuator when in need of maintenance or repair afterward. Moreover, in light of the foregoing drawbacks, users are unable to apply such techniques to high-efficiency and more compact compressors.

It is thus desirable and highly beneficial to develop a novel mechanism for modulating the diffuser vane of a compressor diffuser capable of addressing the foregoing issues.

SUMMARY

In view of the drawbacks associated with the prior techniques, a primary objective of the invention is to provide a mechanism for modulating the diffuser vane of a compressor diffuser that is more compact than conventional mechanisms.

Another primary objective of the invention is to provide a mechanism for modulating the diffuser vane of a compressor diffuser that provides ease in assembly and convenience for maintenance and repair purposes when required.

To achieve the above and other objectives, the present invention proposes a mechanism for modulating a fluid flow in a diffuser flow path of a compressor diffuser. The mechanism comprises a shroud disposed on the diffuser flow path and having a cam and a driving wheel fixed base; a plurality of diffuser vanes each having a diffuser guide vane disposed in the diffuser flow path and a diffuser vane shaft fixedly disposed on the diffuser vane at a position penetrating from the diffuser flow path through the shroud; a driving ring sleeved on the cam and having a moving bar; a plurality of sliding blocks each having one end connected with one end of the diffuser vane shaft that penetrates through the shroud, and the other end sleeved on a sliding groove formed on the moving bar; a driving wheel disposed in the fixed base of the driving wheel and having a driving shaft connected to an actuator outside of the compressor; and a driving cable connected to the driving wheel and the driving ring, for driving the driving wheel to rotate by the driving shaft that transmits power along a shaft of the compressor, the rotating driving wheel driving the driving ring, such that the moving bar of the driving ring moves in the sliding groove and the sliding blocks are rendered to move and drive the diffuser guide vanes to rotate, thereby modulating disposition angles of the diffuser guide vanes in the diffuser flow path.

Accordingly, the present invention allows the actuator to be installed outside of the compressor, and is characterized by the correlative movements of the actuator, the driving shaft, the driving wheel and the driving ring along the shaft in a radial direction to diametrically transmit dynamic power to rotate the diffuser vane shaft and thus modulate the disposition thereof as required. Compared to prior techniques, the invention is less space-consuming in that it eliminates the need for reserving a space to accommodate the actuator in the compressor which in turn eliminates the needs for complex assemblies and troublesome maintenance when in need of repair.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The following illustrative embodiments are provided to illustrate the disclosure of the present invention, these and other advantages and effects can be understood by persons skilled in the art after reading the disclosure of this specification.

Figure 1:
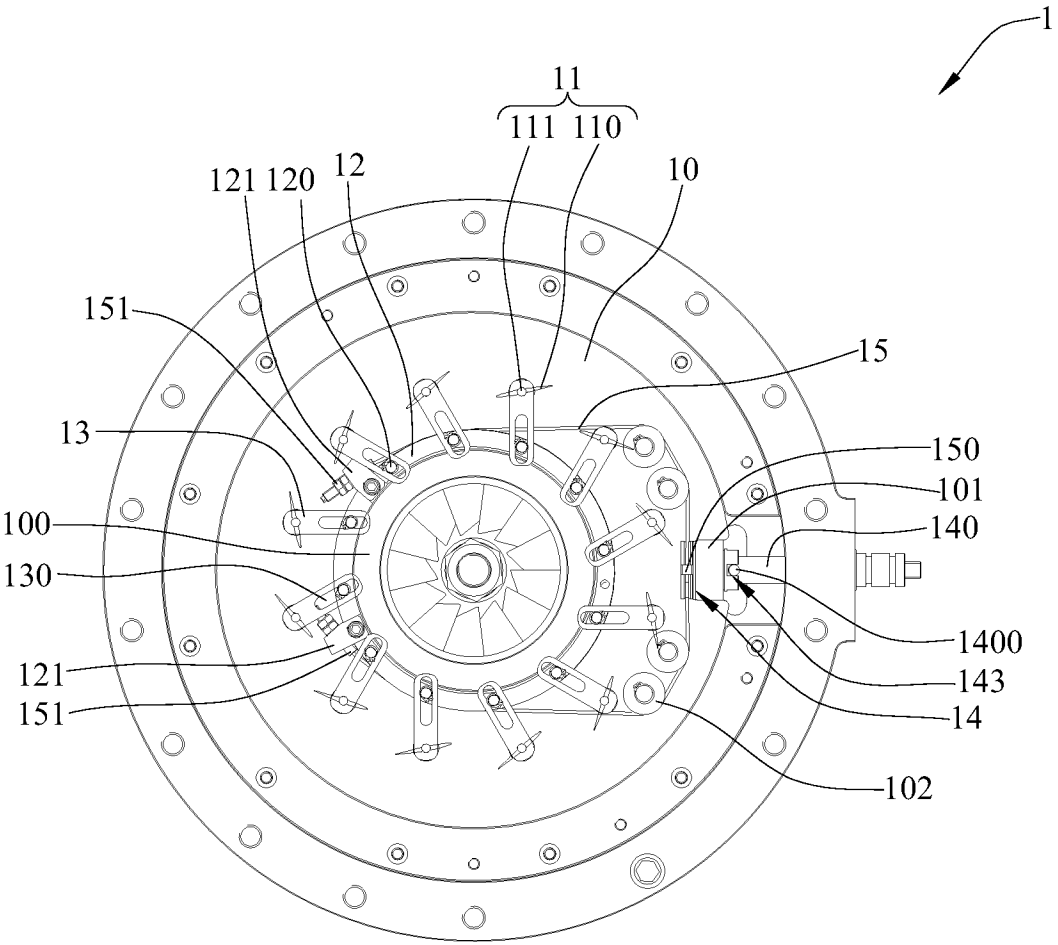
FIG. 1 is a top view of a mechanism for modulating the diffuser vane disposed in a compressor diffuser in accordance with the present invention.
Figure 2:
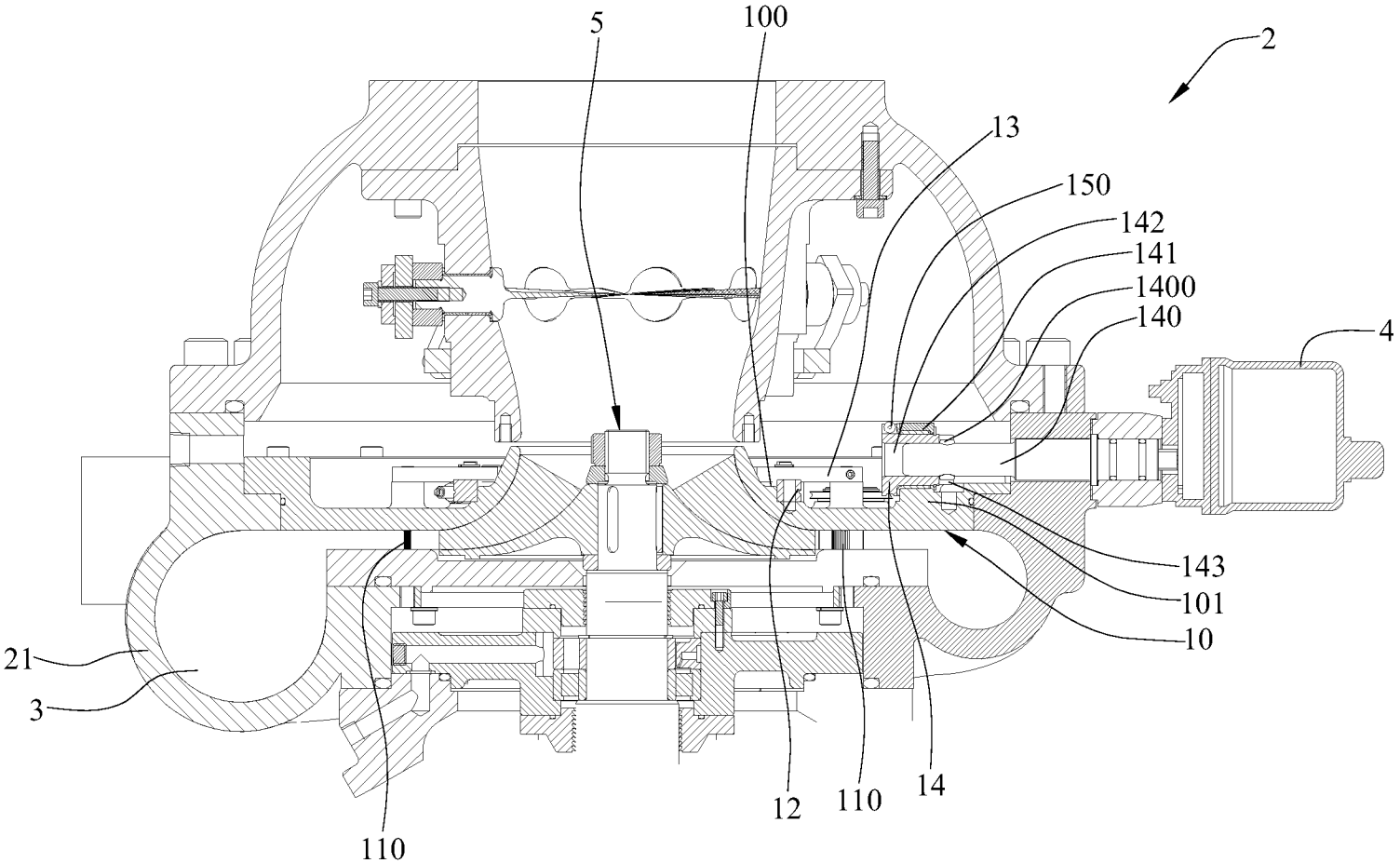
FIG. 2 is a cross-sectional view of the diffuser vane disposed in a compressor diffuser in accordance with the present invention.
Figure 3:
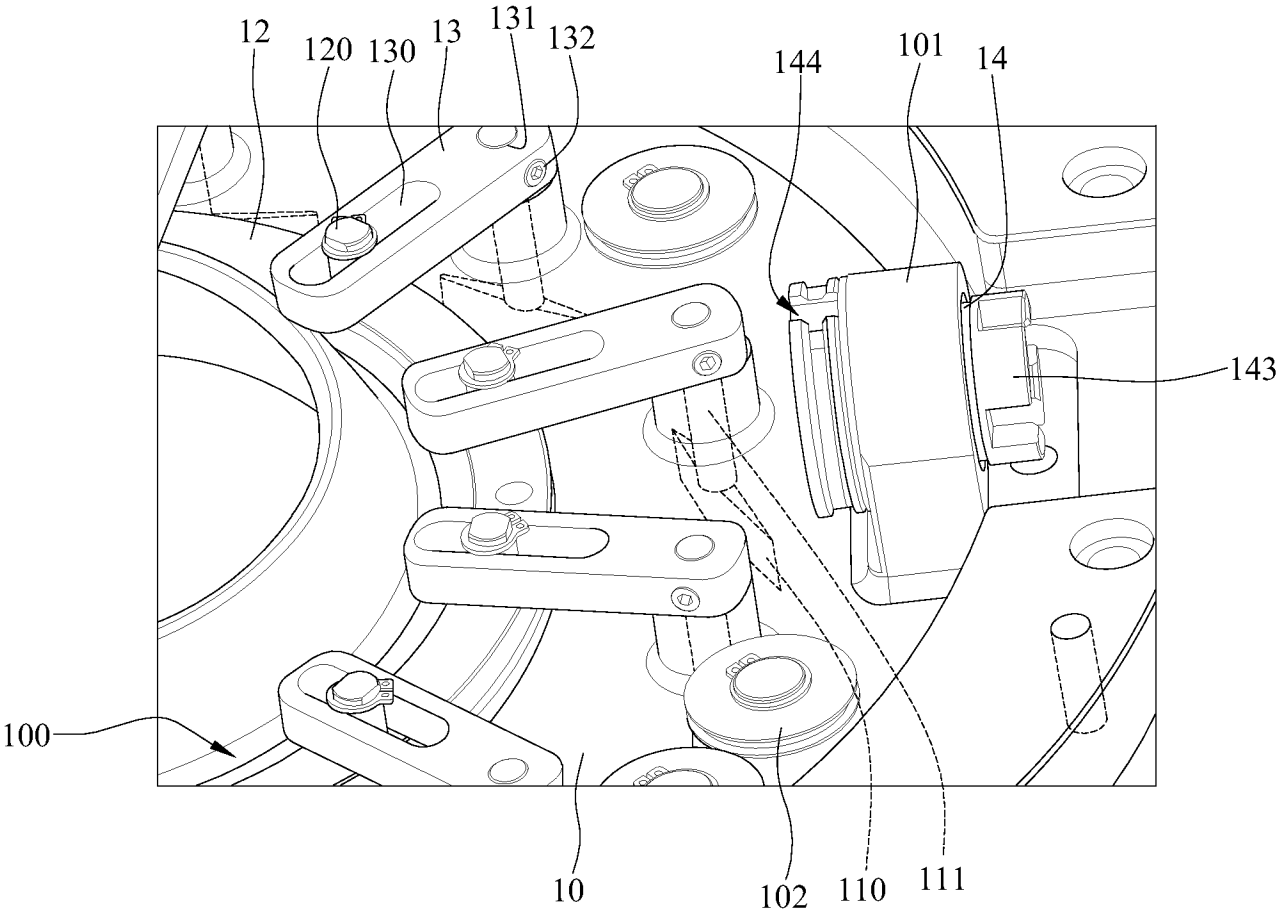
FIG. 3 is a locally enlarged view of the mechanism for modulating the diffuser vane of a compressor diffuser in accordance with the present invention.
Figure 4:
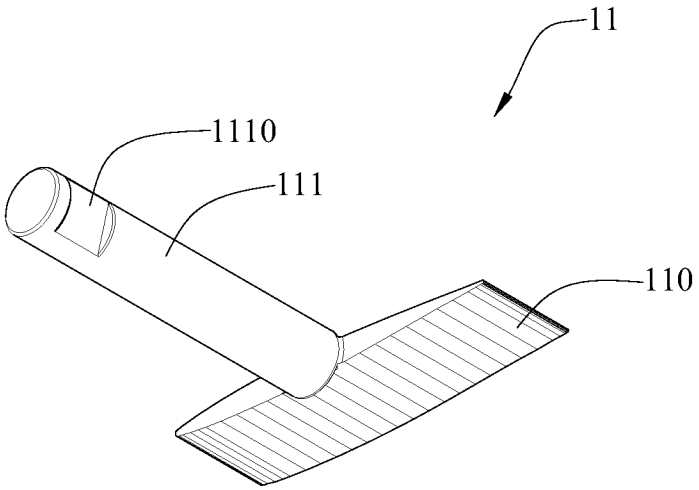
FIG. 4 is a perspective view of the diffuser vane of the modulating mechanism in accordance with the present invention.
Figure 5:
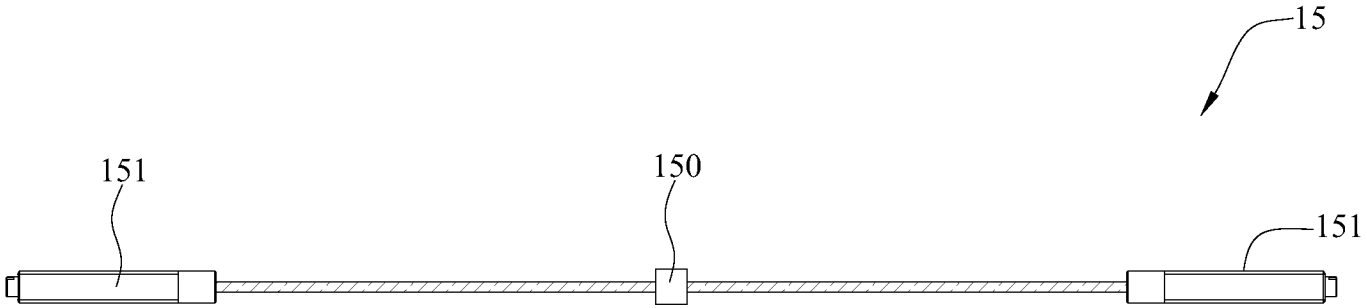
FIG. 5 is a top view of the driving cable of the modulating mechanism in accordance with the present invention.

FIGS. 1, 2, 3, 4 and 5 illustrate the mechanism for modulating the diffuser vane of a compressor diffuser of the present invention. FIG. 1 is a top view of the mechanism for modulating the diffuser vane disposed in a compressor diffuser according to the present invention. FIG. 2 is a cross-sectional view of the diffuser vane of a compressor diffuser according to the present invention. FIG. 3 is a locally enlarged view of the mechanism for modulating the diffuser vane of a compressor diffuser according to the present invention. FIG. 4 is a perspective view of the diffuser vane of the modulating mechanism according to the present invention. FIG. 5 is a top view of the driving cable of the modulating mechanism in accordance with the present invention.

The mechanism 1 for modulating the diffuser vane of a compressor diffuser comprises a shroud 10, a plurality of the diffuser vanes 11, a driving ring 12, a plurality of sliding blocks 13, a driving wheel 14, and a driving cable 15. The mechanism 1 modulates flow directions of a diffuser flow path 3 in a housing 21 of a compressor diffuser 2. Note that the disposal quantity and positions of the diffuser vanes 11 and sliding blocks 13 can vary according to users' requirements. Moreover, the driving cable 13 is not shown FIG. 3 in view of difficult contrast depiction. The compressor diffuser 2 depicted in FIG. 2 is a one-stage compressor. In an embodiment, the compressor diffuser 2 may be a compressor having two or more stages and be provided with a shaft 5 disposed close to the compressor diffuser 2.

The shroud 10 is disposed on the diffuser flow path 3 and has a cam 100 disposed close to the middle portion thereof and a driving wheel fixed base 101 disposed on top of the shroud 10, and all of the foregoing parts can be integrally formed.

Each of the diffuser vanes 11 has a diffuser guide vane 110 disposed in the diffuser flow path 3 and a diffuser vane shaft 111 fixedly disposed on the diffuser guide vane 110 at a position penetrating from the diffuser flow path 3 through and protruding from the shroud 10.

The driving ring 12 is rotatably sleeved on the cam 100 of the shroud 10 and has a plurality of moving bars 120 corresponding to the diffuser vanes 11 and is fixedly locked on the driving ring 12.

A plurality of sliding blocks 13 correspond to the moving bars 120 that are disposed on the driving ring 12. Each of the sliding blocks 13 has one end connected with one end of the diffuser vane shaft 111 that is disposed on the diffuser vane 11 and penetrates through the shroud 10 to be locked in the shaft hole 131 of the sliding blocks 13, and the other end having a sliding groove 130 formed therein, wherein the moving bars 120 of the driving ring 12 are sleeved in the sliding grooves.

The driving wheel 14 is rotatably disposed in the fixed base 101 of the shroud 10, and has a driving shaft 140 that is connected to an actuator 4 that is disposed outside of the compressor diffuser 2. The driving cable 15 is connected to both the driving wheel 14 and the driving ring 12.

In actual implementation, the actuator 4 transmits power, via the driving shaft 140 along the axial rotation of the compressor diffuser 2, to rotate the driving wheel 14, which then rotates the driving ring 12 by the driving cable 15, making the moving bars 120 of the driving ring 12 to slide within the sliding groove 130 and move the sliding blocks 13, thereby concurrently moving the diffuser vane shaft 111 of the diffuser vane 11 to modulate disposition angles in the diffuser flow path 3. Therefore, the working efficiency is effectively increased, and the panting vibrations is decreased, thus expanding operating ranges of low negative load of the compressor diffuser 2. Especially, the technique proposed by the present invention can expand operating ranges of low negative load of the compressor diffuser 2.

In this embodiment, the shroud 10 may further include one or more idle wheels 102. The driving cable 15 can be connected through idle wheels 102 with driving wheel 14 and the driving ring 12, thereby providing greater exertion and moment of force while preventing the driving cable 15 from coming into contact with the sliding blocks 13 in the modulation process. The driving cable 15 may comprise two fixed screws 151, and the driving ring 12 may have two stopping blocks 121. Accordingly, the driving ring 12 and the driving cable 15 may be locked by screw nuts onto the stopping blocks 121 and coupled with one another. The two fixed screws 151 may be posited on two ends of the driving cable 15, respectively, to maintain an utmost torque and balance.

Further, the connected end of the sliding blocks 13 and the diffuser vane shaft 111 of the diffuser vane 11 may have a shaft hole 131. Accordingly, the diffuser vane shaft 111 of the diffuser vane 11 may penetrate from the shroud 10 into the shaft holes 131 to thereby fixedly connect the sliding blocks 13 with the diffuser vane shaft 111 of the diffuser vane 11. Specifically, a positioning screw 132 may be opted to penetrate from a side through sliding blocks 13 and the shaft hole 131 to be in tight contact with a positioning groove 1110 formed on the diffuser vane shaft 111, thereby fastening the diffuser vane shaft 111 of the diffuser vane 11 in the shaft hole 131 of sliding blocks 13. Further, the diffuser vane shaft 111 of the diffuser vane 11 may have a positioning groove 1110 formed corresponding to the angles of the diffuser vane 110, for the purpose of setting the included angle of the diffuser vane shaft 111 of the diffuser vane 11 and sliding blocks 13 when the diffuser vane 11 and sliding blocks 13 are initially assembled.

Additionally, for the convenience of assembly, the driving wheel 14 may be freely disposed in the driving wheel fixed base 101 by means of a shaft sleeve cover 141. The driving wheel may be provided with an inner hole 142 and a driving groove 143, and the driving shaft 140 may comprise a connecting pin 1400. Specifically, in assembling the driving wheel 14 and the driving shaft 140, the driving shaft 140 may be inserted into the inner hole 142 of the driving wheel 14 from the outside of the compressor diffuser 2 for connecting the driving shaft 140 with the driving wheel 14, and the connecting pin 1400 formed on the driving shaft 140 is to be embedded into the driving groove 143 of the driving wheel so as to securely connect the driving shaft 140 with the driving wheel 14, thereby enabling the actuator 4 to achieve an utmost driving effect.

Moreover, the driving wheel 14 may comprise a slot 144 and the driving cable 15 is provided with a relative-moving block 150, such that when initially assembling the driving wheel 14 with the driving cable 15, the relative-moving block 150 of the driving cable 15 can be embedded into the slot 144 of the driving wheel 14 to become securely engaged.

Summarizing the above, the invention is characterized by the correlative movement of the actuator, the driving shaft, the driving wheel and the driving ring along an axial direction of the compressor shaft to diametrically transmit dynamic power to rotate the diffuser vane and thus modulate the disposed angles thereof as required. Compared to prior techniques, the invention is less space-consuming in that it eliminates the need for reserving a space to accommodate the actuator in the compressor, which in turn eliminates the needs for complex assemblies and troublesome maintenance when in need of repair.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A mechanism for modulating a fluid flow in a diffuser flow path of a compressor diffuser, the mechanism comprising:

a shroud disposed on the diffuser flow path and having a cam and a driving wheel fixed base;

a plurality of diffuser vanes each having a diffuser guide vane disposed in the diffuser flow path and a diffuser vane shaft fixedly disposed on the diffuser guide vane at a position penetrating from the diffuser flow path through the shroud;

a driving ring sleeved on the cam and having a moving bar;

a plurality of sliding blocks each having one end connected with one end of the diffuser vane shafts that penetrates through the shroud, and another end having a sliding groove, the moving bar being sleeved on the sliding grooves;

a driving wheel disposed in the driving wheel fixed base and having a driving shaft connected to an actuator outside of the compressor diffuser, the driving shaft transmitting power along a shaft of the compressor diffuser; and a driving cable, connected to the driving wheel and the driving ring, for driving the driving wheel to rotate by the driving shaft that transmits said power, the rotating driving wheel driving the driving ring such that the moving bar of the driving ring moves in the sliding grooves and the sliding blocks are rendered to move and drive the diffuser guide vanes to rotate, thereby modulating disposition angles of the diffuser guide vanes in the diffuser flow path.

2. The mechanism of claim 1, wherein the shroud further comprises at least one idle wheel for allowing the driving wheel to be connected with the driving ring by the driving cable.

3. The mechanism of claim 1, wherein the diffuser vane shafts of the diffuser vanes have positioning grooves for setting included angles of the diffuser vane shafts with respect to the sliding blocks.

4. The mechanism of claim 3, wherein the positioning grooves are disposed to correspond to a disposition of the diffuser guide vanes.

5. The mechanism of claim 1, further comprising fasteners, wherein the one ends of the sliding blocks, that are connected to the diffuser vane shafts, have shaft holes for allowing the diffuser vane shafts to be positioned and locked in the shaft holes by the fasteners.

6. The mechanism of claim 1, further comprising a shaft sleeve cover, wherein the driving wheel is rotatably disposed in the driving wheel fixed base through the shaft sleeve cover.

7. The mechanism of claim 1, wherein the driving wheel has an inner hole and a driving groove, and the driving shaft further comprises a connecting pin that is embedded into the driving groove when the driving shaft is inserted into the inner hole.

8. The mechanism of claim 1, wherein the driving cable is provided with a relative-moving block and the driving wheel is formed with a slot for receiving the relative-moving block therein.

9. The mechanism of claim 1, further comprising fasteners, wherein the driving cable comprises two fixed screws, and the driving wheel has two stopping blocks for allowing the driving ring and the driving cable to be locked by the fasteners onto the two stopping blocks and coupled with one another.

10. The mechanism of claim 9, wherein the two fixed screws are posited on two ends of the driving cable.

11. The mechanism of claim 1, wherein the cam, the driving wheel fixed base and the shroud are integrally formed.

12. The mechanism of claim 1, wherein the moving bar is fixedly locked onto the driving ring.

13. The mechanism of claim 1, wherein the moving bar slides along a longitudinal axis of the sliding grooves to change a position of the moving bar relative to a longitudinal end of the sliding blocks to move and drive the diffuser guide vanes.

* * * * *